US010618152B2

(12) United States Patent
Rigdon et al.

(10) Patent No.: US 10,618,152 B2
(45) Date of Patent: Apr. 14, 2020

(54) ALL-DIRECTION VALVE AND HANDHELD POWER TOOL HAVING SAME

(71) Applicant: Black & Decker Inc., Newark, DE (US)

(72) Inventors: William Rigdon, Baltimore, MD (US); Daniel J. White, Middle River, MD (US); Matthew J. Velderman, Baltimore, MD (US); Derek Marchanti, Nottingham, MD (US); Gary Hill, Red Lion, PA (US)

(73) Assignee: Black & Decker Inc., Newark, DE (US)

( * ) Notice: Subject to any disclaimer, the term of this patent is extended or adjusted under 35 U.S.C. 154(b) by 229 days.

(21) Appl. No.: 15/672,976

(22) Filed: Aug. 9, 2017

(65) Prior Publication Data

US 2019/0047128 A1 Feb. 14, 2019

(51) Int. Cl.

| | |
|---|---|
| ***B25C 1/08*** | (2006.01) |
| ***F01B 11/04*** | (2006.01) |
| ***F02B 63/02*** | (2006.01) |
| *B25C 1/00* | (2006.01) |
| *F02B 1/04* | (2006.01) |

(52) U.S. Cl.

CPC ..... *B25C 1/08* (2013.01); *F01B 11/04* (2013.01); *F02B 63/02* (2013.01); *B25C 1/008* (2013.01); *F02B 1/04* (2013.01)

(58) Field of Classification Search

CPC ..... F16L 37/28; B65D 83/84; B65D 83/682; B65D 83/62; B65D 11/00414; B25C 1/08

USPC ..... 227/8–11; 222/402.1; 123/46 SC

See application file for complete search history.

(56) References Cited

U.S. PATENT DOCUMENTS

| | | | | |
|---|---|---|---|---|
| 3,155,290 A | | 11/1964 | Venus, Jr. | |
| 3,315,693 A | * | 4/1967 | Braun | B05B 11/0059 137/43 |
| 3,447,551 A | * | 6/1969 | Braun | B65D 83/36 137/38 |
| 3,542,254 A | | 11/1970 | Samuelson et al. | |

(Continued)

FOREIGN PATENT DOCUMENTS

| | | | |
|---|---|---|---|
| GB | 2058229 | A | 4/1981 |
| JP | H0542979 | A | 2/1993 |
| WO | 2005099968 | A1 | 10/2005 |

OTHER PUBLICATIONS

International Search Report and Written Opinion for International Application No. PCT/US2018/045821, dated Oct. 24, 2018, 9 pages.

*Primary Examiner* — Nathaniel C Chukwurah

(74) *Attorney, Agent, or Firm* — Brake Hughes Bellermann LLP

(57) ABSTRACT

A handheld combustion powered fastening tool may include a driving system that drives fasteners into workpieces in response to combustion of fuel by the driving system. A fuel delivery system may supply fuel to the driving system. The fuel delivery system may include a fuel canister storing liquid fuel, such as liquid hydrocarbons such as propane, and all direction valve, supplying fuel from the fuel canister to the driving system for combustion. The valve may supply fuel to the driving system in a multiplicity of orientations of the valve/canister/tool, allowing the tool to be operable in a plurality of different orientations, including an upright orientation and an inverted orientation.

16 Claims, 6 Drawing Sheets

(56) References Cited

U.S. PATENT DOCUMENTS

| | | | | | |
|---|---|---|---|---|---|
| 3,556,171 | A | | 1/1971 | Gangwisch et al. | |
| 3,733,013 | A | | 5/1973 | Doyle | |
| 3,893,596 | A | | 7/1975 | Beres et al. | |
| 4,154,271 | A | | 5/1979 | Saeki | |
| 4,371,098 | A | | 2/1983 | Nozawa et al. | |
| 4,522,162 | A | * | 6/1985 | Nikolich | B25C 1/08 123/46 SC |
| 4,723,692 | A | | 2/1988 | Meuresch et al. | |
| 4,942,985 | A | * | 7/1990 | Schultz | B05B 11/0059 222/376 |
| 4,978,038 | A | * | 12/1990 | Sullivan | B65D 83/36 137/43 |
| 5,005,738 | A | * | 4/1991 | Tempelman | B65D 83/36 137/38 |
| 5,350,008 | A | * | 9/1994 | Liu | B22D 11/055 164/440 |
| 5,573,043 | A | | 11/1996 | Fuehrer et al. | |
| 5,803,319 | A | * | 9/1998 | Smith | B05B 11/0059 222/402.19 |
| 5,850,947 | A | | 12/1998 | Kim | |
| 5,979,714 | A | | 11/1999 | Bleile et al. | |
| 6,016,934 | A | | 1/2000 | Moriguchi | |
| 6,158,643 | A | | 12/2000 | Phillips | |
| 6,889,731 | B2 | | 5/2005 | Vallon et al. | |
| 7,028,866 | B2 | | 4/2006 | Kunesh et al. | |
| 8,074,847 | B2 | | 12/2011 | Smith | |
| 8,505,774 | B2 | | 8/2013 | Nimmo et al. | |
| 8,869,842 | B2 | | 10/2014 | Smith | |
| 8,960,503 | B2 | | 2/2015 | Soliman | |
| 9,334,103 | B2 | | 5/2016 | Soliman | |
| 9,394,098 | B2 | | 7/2016 | Kohls et al. | |
| 2008/0135598 | A1 | | 6/2008 | Burke et al. | |
| 2016/0368700 | A1 | | 12/2016 | Smith et al. | |
| 2017/0036848 | A1 | | 2/2017 | Chury et al. | |

* cited by examiner

ALL-DIRECTION VALVE AND HANDHELD POWER TOOL HAVING SAME

FIELD

This document relates, generally, to a valve, and in particular, to an all direction valve for a handheld power tool.

BACKGROUND

Power tools, and in particular, power tools used for fastening, may drive a fastener from the tool and into a workpiece in response to power supplied to the fastening tool. Power may be supplied to the fastening tool by, for example, an electrical power source supplying power to the tool through a cord, a compressed air source supplying compressed air to the tool through a hose, a battery supplying stored electrical power to the tool, and the like. Fastening tools driven by electrical power and/or compressed air may operate, essentially, as long as a source of power is available. However, the use of fastening tools driven by electrical power and/or compressed air may, in some circumstances, be cumbersome due to the attachment of the tool to the cord and/or the hose supplying power to the tool, and/or may be limited by the availability of the electrical power and/or compressed air within the range of the tool afforded by the length of the cord and/or the hose. Thus, use of these types of corded tools may also be inconvenient when compared to a cordless tool providing the same capability. For example, use of a battery to supply power to the fastening tool may eliminate the need for a cord or hose attachment of the tool to the power source. However, fastening tools driven by power supplied by a battery may have a relatively limited operating period within the life of the battery, and may be relatively heavy and less nimble. Cordless, combustion powered tools may provide a favorable alternative to corded and/or battery powered tools, due to combination of power, runtime, and lightweight ergonomics.

SUMMARY

In one aspect, a combustion powered fastening tool may include a housing, a driving system included in the housing, and a fuel delivery system included in the housing and configured to deliver fuel to the driving system. The driving system may be configured to exert a driving force on a fastener in response to combustion of fuel delivered to the driving system by the fuel delivery system. The fuel delivery system may include a fuel canister, a 360-degree, all-direction valve at a first end portion of the fuel canister, a capillary tube, or dip tube, included in the canister, the dip tube having a first end coupled to the 360-degree valve, and a second end positioned at a second (opposite) end portion of the fuel canister. In a first mode, fuel is drawn from an interior of the canister into the 360-degree valve through the dip tube. In a second mode, fuel is drawn from the interior of the canister into the 360-degree valve through an opened portion of the 360-degree valve.

In some implementations, operation in the first mode and operation in the second mode may be determined by the orientation of the all direction valve and fuel canister with respect to gravity.

In another aspect, a 360-degree, all-direction valve for a combustion powered fastening tool may include a housing configured to be coupled to first end portion of a fuel canister, and to a dip tube extending to a second end portion of the fuel canister, and a fuel flow passage extending through the housing and configured to direct a flow of fuel through the housing. The fuel flow passage may include a first inlet portion defined in the housing, at a position aligned with the dip tube, a second inlet portion defined in a side wall portion of the housing, and an outlet portion directing the flow of fuel from the fuel flow passage to a secondary, or successive valve to release the fuel for combustion. The valve may also include a channel defined in the housing, and a dynamic or movable member movably positioned in the channel, so as to move in the channel in response to movement of the valve installed in the tool. In a first mode, moveable member is in a first position in the channel, blocking the second inlet portion. In a second mode, the moveable member is in a second position in the channel, in which the second inlet portion is open.

In another aspect, a combustion powered fastening tool may include a tool housing, a fuel canister received in the tool housing, the fuel canister storing liquid fuel, and a 360-degree valve coupled to the fuel canister to supply fuel from the fuel canister to a combustion chamber. The 360-degree valve may include a valve housing configured to be coupled to first end portion of the fuel canister, and to a dip tube extending to a second end portion of the fuel canister, and a fuel flow passage extending through the housing and configured to direct a flow of fuel through the housing. The fuel flow passage may include a first inlet portion defined in the housing, at a position aligned with the dip tube, a second inlet portion defined in a side wall portion of the housing, and an outlet portion directing the flow of fuel from the fuel flow passage to an external valve for combustion. The valve may also include a channel defined in the valve housing, and a movable member movably positioned in the channel, so as to move in the channel in response to movement of the valve with respect to gravity. Although the valve may reside in fixed orientation when installed in tool, the tool may be used in any orientation and successful function may rely on response of the valve to changes in tool orientation.

The details of one or more implementations are set forth in the accompanying drawings and the description below. Other features will be apparent from the description and drawings, and from the claims.

DETAILED DESCRIPTION

Figure 1A:
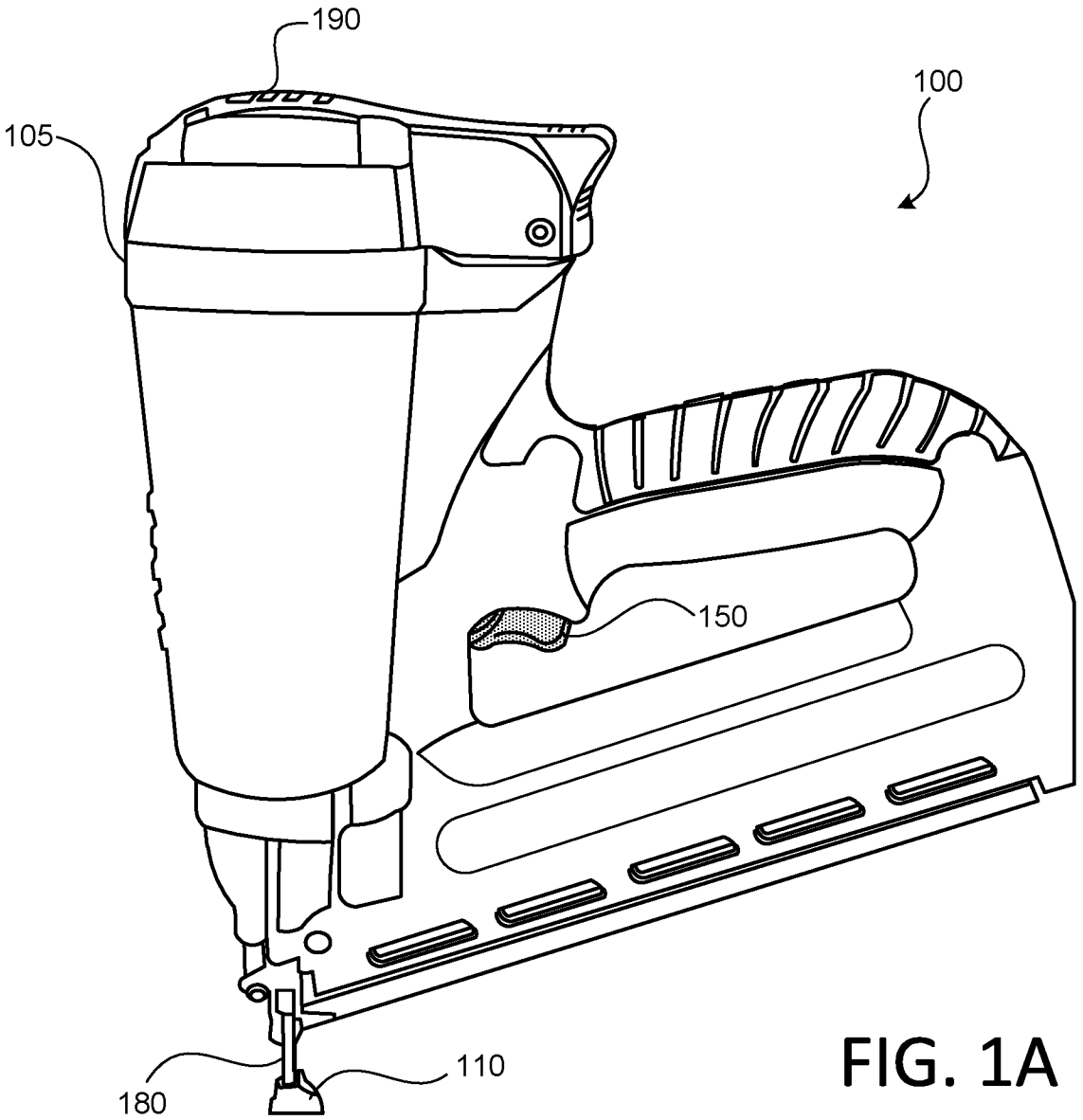
FIG. 1A is a perspective view of an example combustion-powered tool.

A combustion powered tool, in accordance with implementations described herein, may be driven by the combustion of fuel. For example, a liquid fuel, such as a liquid hydrocarbon fuel, contained in a fuel cell, or fuel canister, received in a housing of the tool and/or coupled to the housing of the tool can be used for storage and delivery of fuel. In a combustion powered tool, a valve, for example, an all-direction valve, or a 360-degree valve, in accordance with implementations described herein, may dispense liquid fuel from a fuel canister of the tool into a combustion chamber of the tool, in a variety of different (substantially all) orientations of the tool, and a variety of different (substantially all) orientations of the fuel canister, including for example, an upright orientation of the tool/fuel canister and an inverted orientation of the tool/fuel canister. This may allow the tool to operate, regardless of the orientation of the tool, and without significant variations in performance.

A fuel canister for a combustion powered tool may utilize a bag-in-can or can-in-can construction to provide for fuel discharge from the canister at a variety of different orientations of the tool. A bag-in-can and/or can-in-can construction may rely on two separated volumes or cavities encompassed within an external container. These separate cavities may include a first, internal cavity for storing the fuel, and a second, surrounding cavity filled with a pressurized gas or propellant and encompassed by the outer walls of the external container. The propellant in the second cavity may help maintain a fluid state of the fuel, and may exert pressure on the first cavity to collapse the first cavity as fuel is discharged from the first cavity. This construction also serves the purpose of maintaining fluid presence at the outlet valve(s) in substantially all orientations. However, fuel canisters utilizing bag-in-can and/or can-in-can construction may be relatively complex, and relatively costly to manufacture. Additionally, fuel canisters utilizing bag-in-can and/or can-in-can construction are not readily refilled and/or reused. An all-direction valve coupled to a fuel canister, in accordance with implementations described herein, may allow for the use of a fuel canister having a single-walled construction, rather than a bag-in-can or a can-in construction, to provide for the dispensing of fuel from the fuel canister at different orientations. An all-direction valve coupled to a fuel canister, in accordance with implementations described herein, may provide for the refilling and re-use of fuel canisters with simplified transfer techniques.

This arrangement for the fuel canister may eliminate the need for a cord to supply electrical power to the tool, or a hose to supply compressed air to the tool, or a battery to supply power to the tool, and the like. Elimination of the cord and/or hose tethering the tool to a source of electricity and/or compressed air, and/or elimination of additional weight due to the battery, may provide enhanced flexibility in movement and positioning of the tool. The use of this type of fuel may allow for operation of the tool while out of range of an electrical power source and/or a compressed air source, and/or for a longer period of time than would normally be supplied by a battery without re-charging or replacement.

Figure 1B:
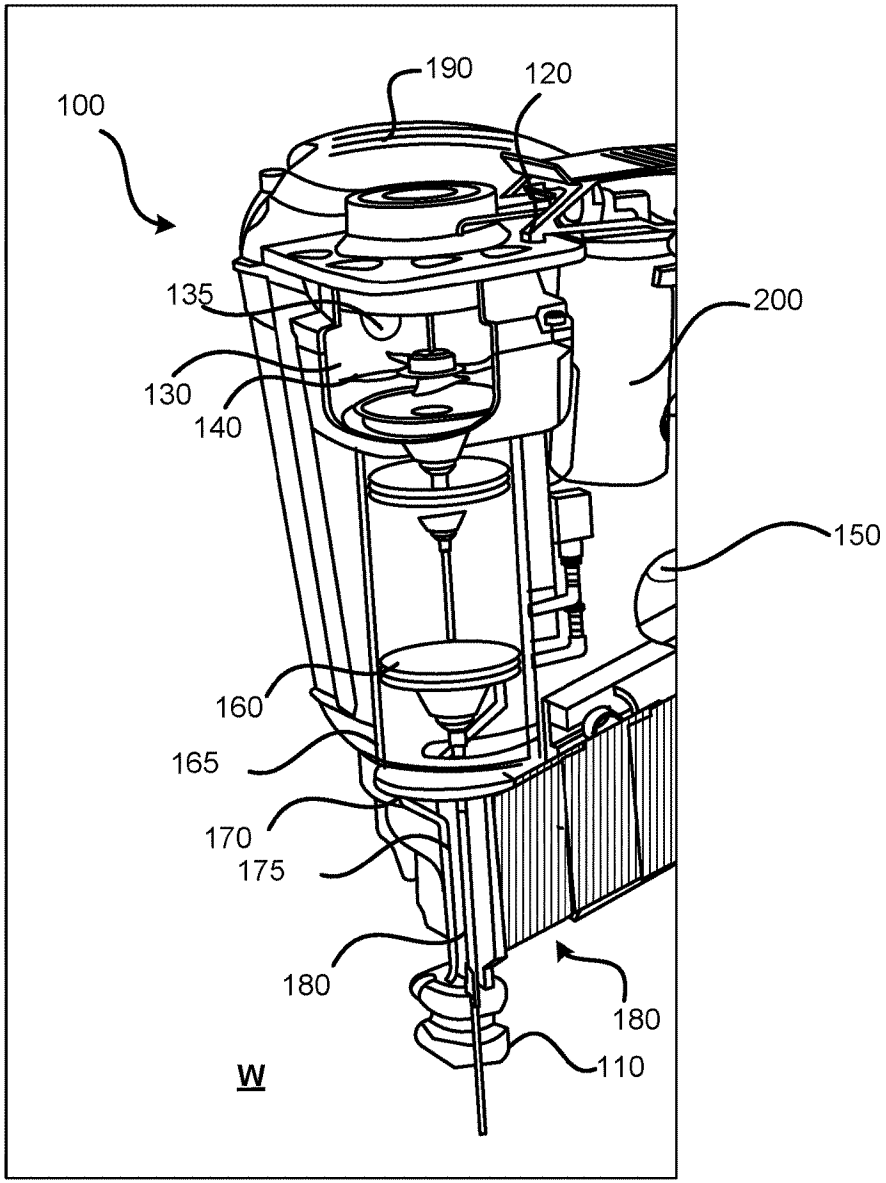
FIG. 1B is cutaway perspective view of the tool shown in FIG. 1A, in accordance with implementations described herein.

An example implementation of a power tool is shown in FIGS. 1A and 1B. A handheld fastening tool 100, and in particular, a nailing tool, is illustrated in the example shown in FIGS. 1A and 1B, simply for ease of discussion and illustration. However, the principles to be described herein may be applied to other types of combustion powered tools, such as, for example, other types of fastening tools, including, for example, riveting tools, stapling tools, and the like. The principles to be described herein may be applied to other types of tools, in addition to fastening tools, such as, for example, impact tools, demolition tools, crimping tools, and the like.

The example fastening tool 100 shown in FIGS. 1A and 1B includes a housing 105, and a driving system configured to drive a fastener into a workpiece W. The driving system operates in response to fuel delivered to the driving system by a fuel delivery system, and combustion of the fuel by the driving system. A plurality of fasteners 180 may be arranged in a magazine received in the housing 105. The driving system of the tool 100 may drive a fastener 180 into the workpiece W in response to actuation of a trigger 150 of the tool 100. In operation, a nose 110 of the example fastening tool 100 may be positioned against the workpiece W, for example, at a position on the workpiece W corresponding to intended placement of a fastener 180. Compression of the nose 110 against the workpiece W may cause closure of a compression chamber 130, and may cause an actuator 120 to dispense fuel from a fuel canister 200 into the combustion chamber 130. The fuel may be dispensed from the canister 200 as a fluid, and may begin to vaporize upon release into the combustion chamber 130, where rotation of a fan 140 may mix the fuel with oxygen. In this state, actuation of the trigger 150 may transmit an electronic pulse to a spark plug 135, igniting the fuel-air mixture in the combustion chamber 130. Reaction of the fuel-air mixture in the combustion chamber 130 may drive movement of a piston 160 (in a downward direction in the orientation illustrated in FIGS. 1A and 1B) within a cylinder 165. The downward movement of the piston 160 may in turn drive a driver blade 170, attached to a bottom portion of the piston 160, toward a fastener 180 (of the plurality of fasteners 180) received in a channel 175, positioned at the end of the driver blade 170. The movement of the driver blade 170 into the channel 175 (in response to the corresponding movement of the piston 160) may drive the fastener 180 out of the channel 175 and into the workpiece W. At the end of the piston stroke, a discharge of exhaust through an exhaust port 190 helps relieve pressure from the piston 160. Removal of pressure from the nose 110 (by, for example, movement of the tool 100 away from the surface of the workpiece W) may allow the combustion chamber 130 to be opened and pressure to be released. This release of pressure and subsequent cooling of the remaining gas may cause a retracting movement of the piston 160 in the cylinder 165, and corresponding return movement of the driver blade 170 out of the channel 175. Another fastener 180, of the plurality of fasteners 180, may then be released or moved into the channel 175.

Figure 2A:
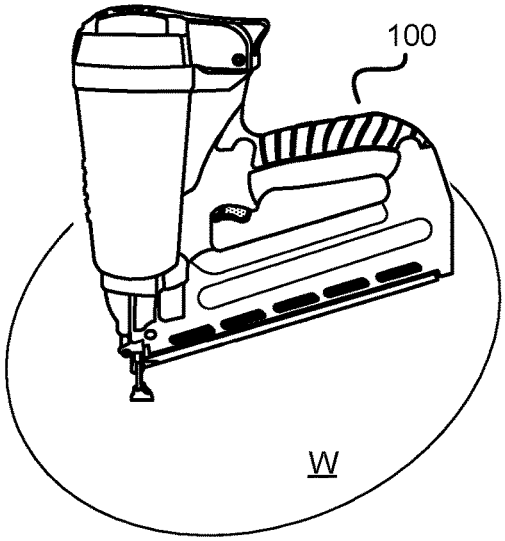
FIGS. 2A-2D illustrate an example combustion powered tool in different orientations with respect to a workpiece, in accordance with embodiments as broadly described herein.
Figure 2B:
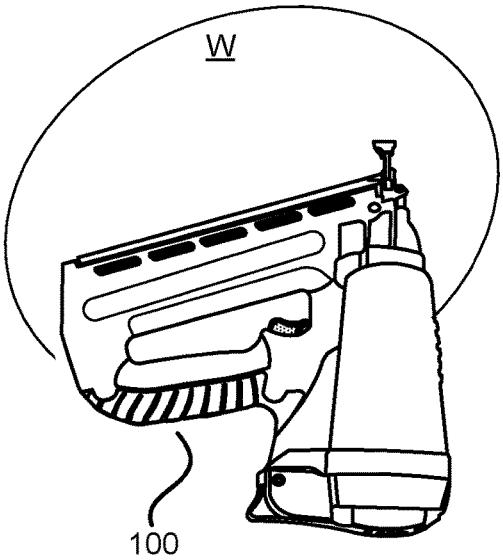
Figure 2C:
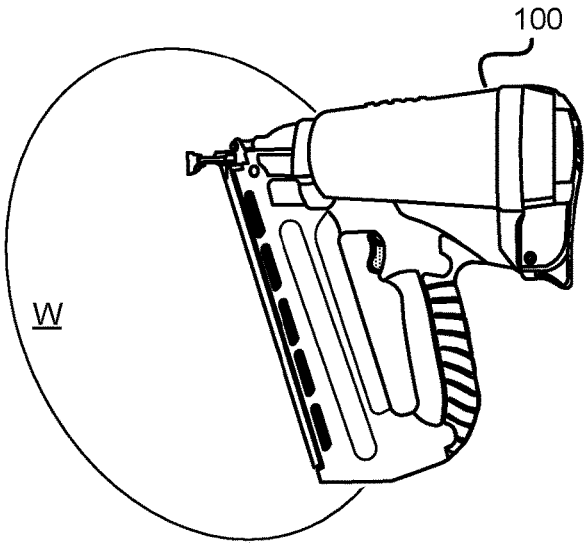
Figure 2D:
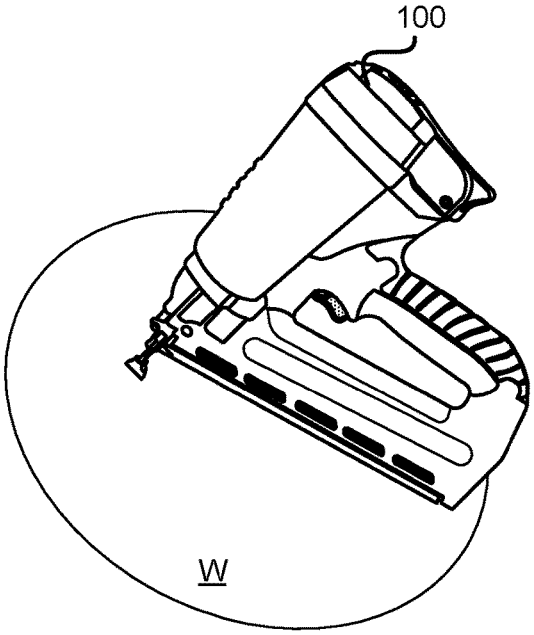

In some implementations, the example fastening tool 100 may include a valve assembly including a 360-degree valve 300, or an all-direction valve 300. The all-direction valve 300 may allow fuel to be dispensed from the fuel canister 200 into the combustion chamber 130 in a plurality of different orientations/positions of the tool 100/canister 200 (for example, in both an upright position of the tool 100/canister 200 and an inverted position of the tool 100/canister 200), such that the fastening tool 100 is substantially continuously operable in a plurality of different orientations. For example, a valve assembly including an all-direction valve 300, in accordance with implementations described herein, may dispense fuel as a fluid (liquid), from the fuel canister 200 which may be vaporized as it enters into the combustion chamber 130 such that the fastening tool 100 is operable with the fuel canister 200 in an upright position with respect to the workpiece W as shown in FIG. 2A (see also, FIG. 5A), and also with the fuel canister 200 in an inverted position with respect to the workpiece W as shown in FIG. 2B (see also, FIG. 5B). In some implementations, the valve assembly including the all direction valve 300 may dispense fuel from the fuel canister 200 to the combustion chamber 130, such that the fastening tool 100 may also be operable with the fuel canister 200 in a horizontal position with respect to the workpiece W as shown in FIG. 2C, and at various other positions/orientations with respect to the workpiece W, as shown in FIG. 2D.

Figure 3:
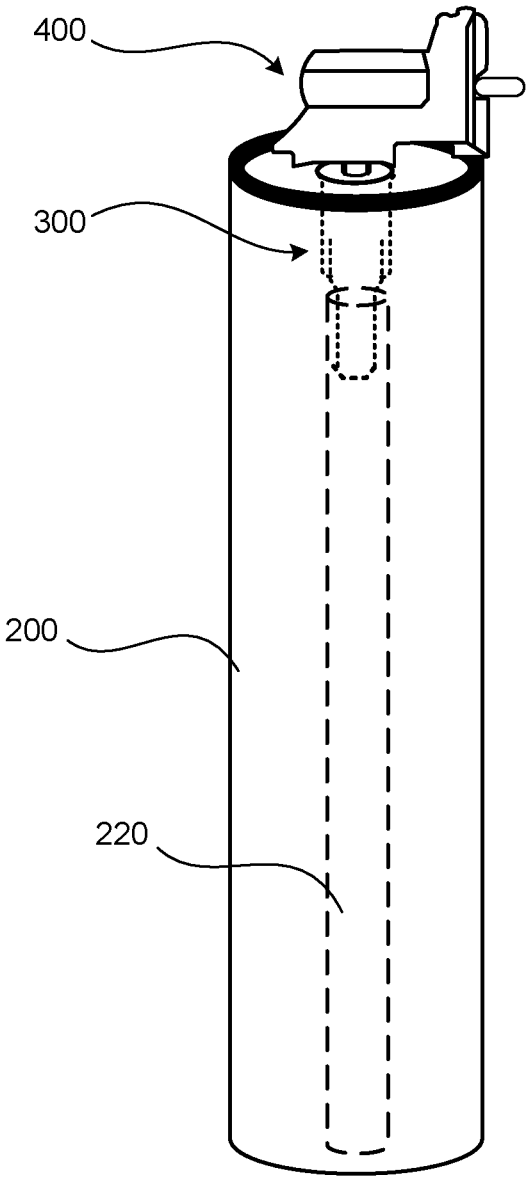
FIG. 3 illustrates an example valve assembly coupled to an example fuel canister, in accordance with implementations as broadly described herein.

An example fuel canister 200 is shown in FIG. 3. For ease of discussion and illustration, the orientation shown in FIG. 3 will be referred to as an upright orientation, or an upright position. As shown in FIG. 3, the valve assembly may include the all-direction valve 300 coupled in the fuel canister 200. A discharge valve 400 may be coupled to an outlet portion of the all-direction valve 300. The all-direction valve 300 may convey fuel from an interior of the canister 200 to a discharge valve 400 for discharge into the combustion chamber 130 of the tool 100. A dip tube 220 may have a first, open end positioned at a bottom portion of the canister 200, and a second, open end coupled to an inlet portion of the valve 300. An internal construction of the all-direction valve 300 may allow fuel, for example, liquid fuel, to be dispensed from the interior of the fuel canister 200 regardless of the orientation of the fuel canister 200/tool 100. This may allow the tool 100 to remain substantially continuously operable, regardless of its orientation, thus enhancing utility of the fastening tool 100, and enhancing user convenience. This may also allow for the use of a single-walled canister, as described above, thus simplifying the construction of the canister, and allowing the canister to be more easily refillable.

Figure 4:
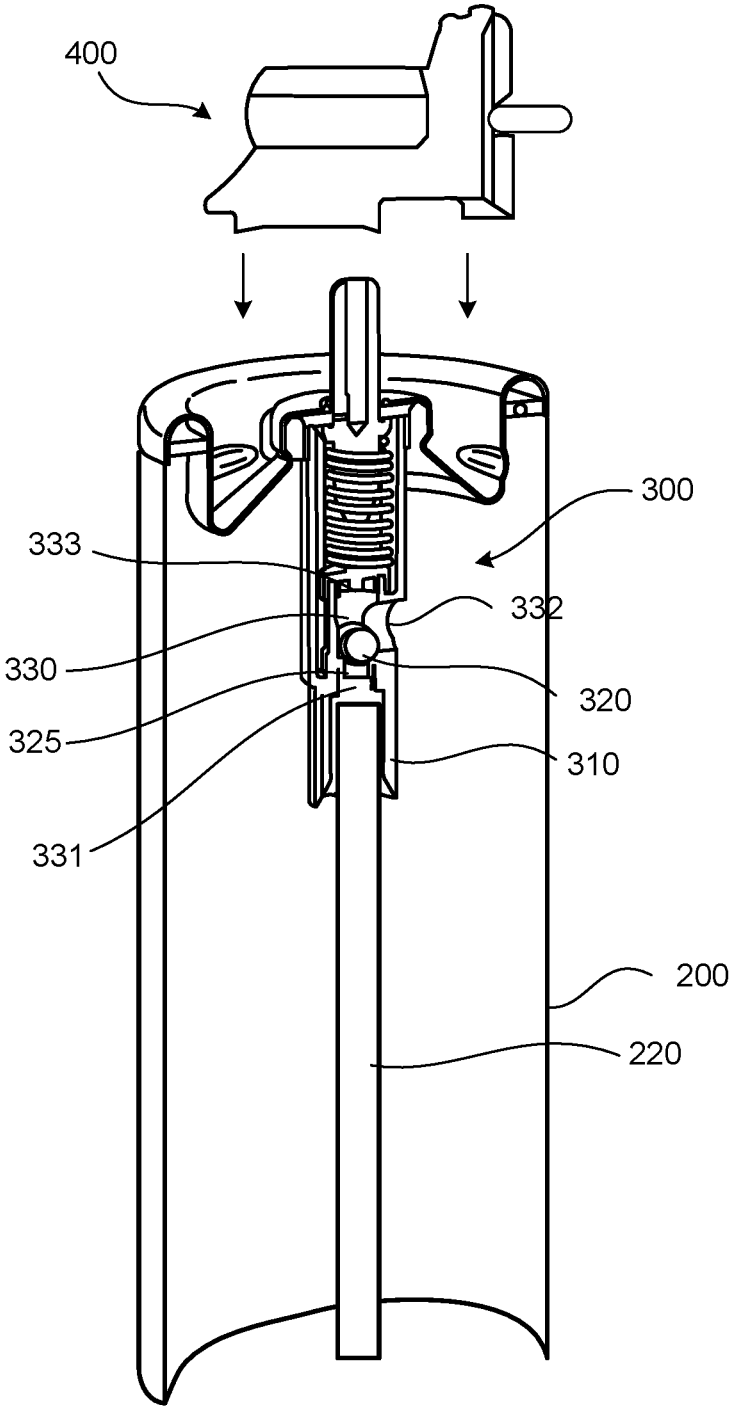
FIG. 4 is a cutaway cross-sectional view of an example valve assembly coupled to an example fuel canister, in accordance with implementations described herein.

FIG. 4 is a cutaway view of the all-direction valve 300 coupled in the fuel canister 200, oriented in an upright position, or in an upright orientation. As shown in FIG. 4, the all-direction valve 300 may include a housing 310, with a bottom end portion of the housing 310 positioned around the open top end portion of the dip tube 220. A fuel flow passage 330 may be formed in the housing 310. The passage 330 may include a first inlet portion 331 defined in a portion of the housing 310 corresponding to the top end portion of the dip tube 220, a second inlet portion 332 defined a side wall portion of the housing 310, and an outlet portion 333 that directs fuel from the all-direction valve 300 to a discharge valve 400. A movable member 320, such as, for example, a ball 320 or other member, may be positioned in a channel 325 defined in the housing 310. Simply for ease of discussion and illustration, hereinafter the movable member 320 will be referred to as a ball 320. However, other members that may move within the channel 325 in response to changes in orientation of the valve 300, due to gravity, may also be positioned in the channel 325. In some implementations, the ball 320 or other movable member may be made of a material having a greater density than the liquid fuel contained in the fuel canister 200. The ball 320 may roll or other movable member may slide, swing, etc. within the channel 325, in response to movement and/or changes in orientation of the canister 200 and the valve 300, to a plurality of different positions, to selectively direct the flow of liquid fuel from the interior of the canister 200, through the all-direction valve 300 to the discharge valve 400.

Figure 5B:
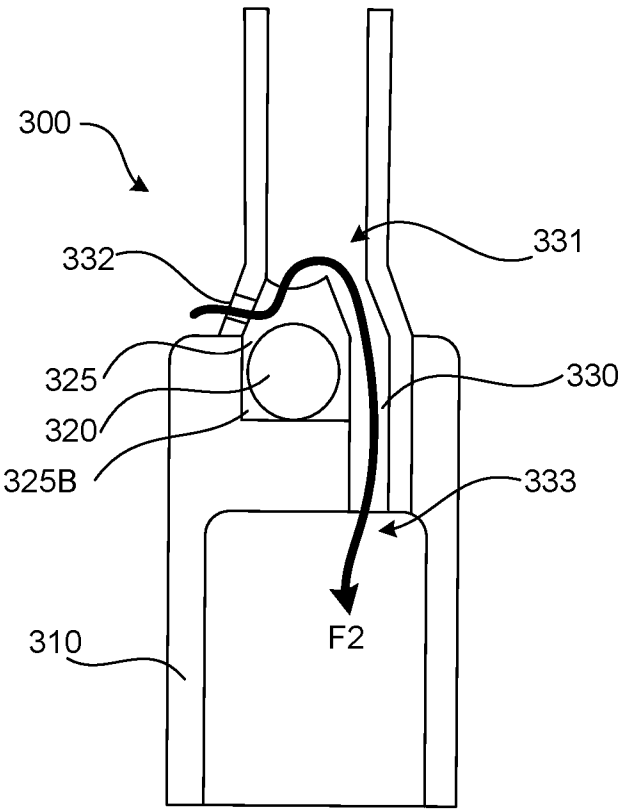
FIGS. 5A and 5B illustrate fuel flow through an example all-direction valve, in accordance with implementations described herein.
Figure 5A:
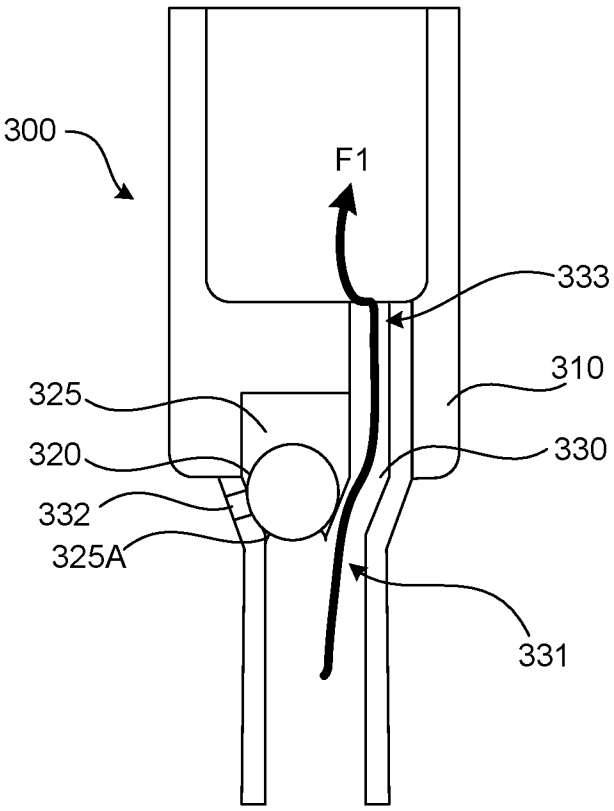

A cross sectional view of the all-direction valve 300 in an upright orientation is shown in FIG. 5A. When in the upright orientation, the ball 320 may be in a first position 325A in the channel 325. In the first position 325A, the ball 320 may substantially block the second inlet portion 332 into the passage 330. In the upright orientation, liquid fuel contained in the fuel canister 200 may flow into the all-direction valve 300 through the first inlet 331. For example, liquid fuel may flow from the interior of the canister 200, and into the dip tube 220 through the open end of the dip tube 220 at the bottom portion of the canister 200. The liquid fuel may flow through the dip tube 220 and into the valve 300 through the first inlet portion 331 of the passage 330, and out of the all-direction valve 300 through the outlet portion 333 of the passage 330, as shown by the arrow F1. Thus, in the upright orientation shown in FIG. 5A, liquid fuel accumulated at the bottom portion of the canister 200, due to the effects of gravity, is drawn or forced up into the valve 300 through the dip tube 220 due to the effects of an internal and external fuel cell pressure differential.

A cross sectional view of the all-direction valve 300 in an inverted orientation is shown in FIG. 5B. When in the inverted orientation, the ball 320 or other moveable member may be in a second position 325B in the channel 325. In the position 325B, the ball 320 or other moveable member may allow liquid fuel from the interior of the canister 200 to flow into the valve 300 through the second inlet portion 332. In the inverted orientation, liquid fuel may be accumulated in the top portion of the canister 200, due to the effects of gravity (rather than at the bottom portion of the canister 200, as in the upright orientation). Thus, in the inverted position, fuel may be drawn into the all-direction valve 300 through the second inlet portion 332 at the side wall portion of the housing 310, and out of all-direction valve 300 through the outlet portion 333 of the passage 330, as shown by the arrow F2.

In a fastening tool with a fuel cell 200 or fuel canister 200 including a 360-degree valve 300, or an all-direction valve 300, in accordance with implementations described herein, liquid fuel may be drawn from the fuel canister 200 into the all-direction valve 300, regardless of an orientation of the fuel canister 200 and the valve 300 installed at the top portion of the canister 200. That is, when the fuel canister 200 and the all-direction valve 300 are in the upright orientation shown in FIG. 5A, the ball 320 or other moveable member is seated at the first position 325A, allowing for the passage of fuel in an axial direction into the all-direction valve 300. In the upright orientation, the liquid fuel is pushed up through the dip tube 220 mainly due to the vapor pressure difference of the fuel versus the atmospheric or combustion chamber pressure outside the canister 200. In some implementations, there may also be effects due to capillary action, surface tension of the fluid, adhesive forces of the fluid with a wall of the dip tube 220, and the like, which may have a less pronounced contribution. When the fuel canister 200 and the all-direction valve 300 are in the inverted orientation show in FIG. 5B, the ball 320 or other moveable member travels to the second position 325B, allowing liquid fuel to flow in a radial direction into the valve 300 through the second inlet portion 332 at the side wall portion of the valve housing 310. This opening of the second inlet portion 332 allows fuel to flow directly into the fuel flow passage 330 of the valve 300 to the outlet portion 330, without passing through the dip tube 220. Thus, the all-direction valve 300 may allow for fuel delivery, from the fuel canister 200, through the valve 300, and to the tool 100, substantially continuously, in essentially any orientation of the tool 100.

A 360-degree valve, or all-direction valve, in accordance with implementations described herein, may allow for the use of a single-walled fuel canister, rather than a double-walled or two cavity containment system as described above. A double-walled or two cavity containment system, such as, for example, a bag-in-can system or a can-in-can system, may include an inner container positioned in an outer container. A product to be delivered, such as, for example, liquid fuel, is placed in the inner container, and a propellant is filled in the space between the inner container and the ridged outer container wall. Vapor pressure exerted by the propellant forces or squeezes or compresses the product out of the inner container with a collapsible wall, allowing for the product to be dispensed with the double-walled containment or two cavity system at different orientations. The single-walled fuel canister afforded by the use of the all-direction valve as described above may provide a simplified and cost effective containment and delivery system allowing liquid fuel to be dispensed at a plurality of different orientations of the system.

An all-direction valve, together with the single-walled fuel canister, in accordance with implementations described herein, may allow for refilling of the fuel canister, rather than disposal of the double-walled/two cavity fuel canister described above (after substantially all of the fuel in the fuel canister has been dispensed). Manufacturing of the two cavity fuel canister having the relatively complex construction described above includes a specialized and complex manufacturing process to separately fill the two cavities. A specialized high pressure pump is required to create enough fluid pressure to overcome the propellant pressure and renders the refilling of the two cavity fuel canister too difficult and unsafe to perform by an end user. Additionally, the foil membrane typically used in a bag-in-can type construction does not have the structural integrity to sustain repeated fill cycles. The thin metal wall typically used in a can-in-can type construction crumples and permanently deforms during the discharge process. Therefore, the inner cavity in these double-walled or two cavity canisters do not facilitate being refilled. In contrast, the single-walled canister with the all-direction valve, in accordance with implementations described herein, may be refilled with a relatively minimal pressure differential supplied by, for example, a light duty pump, a temperature variation between a supply tank and the single wall canister, and the like, and/or a vent valve to refill, allowing a single wall canister with an all-direction valve to be reused and/or refilled.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A combustion powered fastening tool, comprising:

a tool housing;

a driving system included in the tool housing; and a fuel delivery system included in the tool housing and configured to deliver fuel to the driving system, wherein the driving system is configured to exert a driving force on a fastener in response to combustion of fuel delivered to the driving system by the fuel delivery system, the fuel delivery system including:

a fuel canister;

an all-direction valve at a first end portion of the fuel canister, including:

a valve housing;

a fuel flow passage extending through the valve housing;

a first inlet portion formed in an end portion of the valve housing and connected to the fuel flow passage;

a second inlet portion formed in a side wall portion of the valve housing and connected to the fuel flow passage; and a moveable member movably positioned in a channel formed in the valve housing and connected to the fuel flow passage; and a dip tube included in the canister, the dip tube having a first end coupled to the first inlet portion of the all-direction valve, and a second end positioned at a second end portion of the fuel canister, wherein, in a first mode, the moveable member blocks the second inlet portion, and fuel is drawn from an interior of the canister into the all-direction valve through the first inlet portion formed in the valve housing, and in a second mode, the moveable member blocks the first inlet portion, and fuel is drawn from the interior of the canister into the all-direction valve through the second inlet portion formed in the side wall portion of the valve housing of the all-direction valve.

2. The tool of claim 1, wherein, in the first mode, fuel accumulated in the second end portion of the interior of the fuel canister is drawn into the second end of the dip tube, through the dip tube, and into the fuel flow passage of the all-direction valve through the first inlet portion of the fuel flow passage defined in the housing, a position of the first inlet portion corresponding to the first end of the dip tube, and the moveable member is in a first position in the channel, blocking a flow of fuel into the fuel flow passage through the second inlet portion.

3. The tool of claim 2, wherein, in the second mode, the movable member is in a second position in the channel, such that the second inlet portion is open and a flow of fuel into the fuel flow passage through the first inlet portion is blocked, such that, in the second mode, fuel accumulated in the first end portion of the interior of the fuel canister is drawn into the all-direction valve through the second inlet portion and into the fuel flow passage defined in the housing.

4. The tool of claim 3, wherein in the first mode, fuel from the second end portion of the fuel canister flows axially into the housing through the first inlet portion, and in the second mode, fuel from the first end portion of the fuel canister flows radially into the housing through the second inlet portion.

5. The tool of claim 1, wherein the fuel flow passage further includes:

an outlet portion directing the flow of fuel from the fuel flow passage to an external valve for combustion by the driving system.

6. The tool of claim 1, wherein the moveable member is a ball received in the channel, wherein the ball rolls within the channel between a first position blocking the second inlet portion and a second position blocking the first inlet portion.

7. The tool of claim 1, wherein the first mode is an upright mode, and the second mode is an inverted mode.

8. The tool of claim 1, wherein the fuel canister is a single-walled canister.

9. An all-direction valve for a combustion powered fastening tool, comprising:

a housing configured to be coupled to a first end portion of a fuel canister, and to a dip tube extending to a second end portion of the fuel canister;

a fuel flow passage extending through the housing and configured to direct a flow of fuel through the housing, the fuel flow passage including:

a first inlet portion defined in the housing, at a position aligned with the dip tube;

a second inlet portion defined in a side wall portion of the housing; and an outlet portion directing the flow of fuel from the fuel flow passage to a discharge valve for combustion;

a channel defined in the housing; and a moveable member movably positioned in the channel, so as to move in the channel in response to movement of the valve installed in the tool, wherein in a first mode, the moveable member is in a first position in the channel in which the moveable member blocks the second inlet portion to block a flow of fuel into the fuel flow passage through the second inlet portion, and the first inlet portion is open, and in a second mode, the moveable member is in a second position in the channel, in which the moveable member blocks the first inlet portion to block a flow of fuel into the all-direction valve through the first inlet portion, and the second inlet portion is open.

10. The valve of claim 9, wherein in the first mode, fuel is drawn into the housing from an interior of the canister through the dip tube and the first inlet portion, and in the second mode, fuel is drawn into the housing from the interior of the canister through the second inlet portion.

11. The valve of claim 9, wherein in the first mode, fuel accumulated in the second end portion of the fuel canister is drawn into the housing through the dip tube and the first inlet portion, and in the second mode, fuel accumulated in the first end portion of the fuel canister is drawn into the housing through the second inlet portion.

12. The valve of claim 11, wherein in the first mode, fuel from the second end portion of the fuel canister flows axially into the housing through the first inlet portion, and in the second mode, fuel from the first end portion of the fuel canister flows radially into the housing through the second inlet portion.

13. The valve of claim 11, wherein the first mode is an upright mode, and the second mode is an inverted mode.

14. A combustion powered fastening tool, comprising:

a tool housing;

a fuel canister received in the tool housing, the fuel canister storing liquid fuel; and an all-direction valve coupled to the fuel canister to supply fuel from the fuel canister to a combustion chamber, the all-direction valve including:

a valve housing configured to be coupled to a first end portion of the fuel canister, and to a dip tube extending to a second end portion of the fuel canister;

a fuel flow passage extending through the valve housing and configured to direct a flow of fuel through the valve housing, the fuel flow passage including:

a first inlet portion defined in the valve housing, at a position aligned with the dip tube;

a second inlet portion defined in a side wall portion of the valve housing; and an outlet portion directing the flow of fuel from the fuel flow passage to a discharge valve for combustion;

a channel defined in the housing; and a moveable member movably positioned in the channel, so as to move in the channel in response to movement of the all-direction valve installed in the tool, wherein, in a first position of the movable member in the channel, the moveable member blocks the second inlet portion such that the second inlet portion is closed and the first inlet portion is open to allow fuel to flow into the all-direction valve through the first inlet portion, and in a second position of the moveable member in the channel, the moveable member blocks the first inlet portion such that the first inlet portion is closed and the second inlet portion is open to allow fuel to flow into the all-direction valve through the second inlet portion.

15. The tool of claim 14, wherein in a first mode corresponding to the first position of the moveable member in the channel, fuel accumulated in the second end portion of the fuel canister is drawn axially into the valve housing through the dip tube and the first inlet portion, and in a second mode corresponding to the second position of the moveable member in the channel, fuel accumulated in the first end portion of the fuel canister is drawn radially into the valve housing through the second inlet portion.

16. The tool of claim 15, wherein the first mode is an upright mode, and the second mode is an inverted mode.

* * * * *